US005630741A

United States Patent [19]

Potter

[11] Patent Number: 5,630,741

[45] Date of Patent: May 20, 1997

[54] FABRICATION PROCESS FOR A FIELD EMISSION DISPLAY CELL STRUCTURE

[75] Inventor: Michael D. Potter, Grand Isle, Vt.

[73] Assignee: Advanced Vision Technologies, Inc., Rochester, N.Y.

[21] Appl. No.: 438,107

[22] Filed: May 8, 1995

[51] Int. Cl.[6] ..... H01J 9/02

[52] U.S. Cl. ..... 445/24; 445/50

[58] Field of Search ..... 445/24, 49, 50

[56] References Cited

U.S. PATENT DOCUMENTS

| | | | |
|---|---|---|---|
| 4,702,792 | 10/1987 | Chow et al. | 156/628 |
| 4,728,851 | 3/1988 | Lambe | 313/309 |
| 4,789,648 | 12/1988 | Chow et al. | 437/225 |
| 4,827,177 | 5/1989 | Lee et al. | 313/306 |
| 4,857,161 | 8/1989 | Borel et al. | 204/192.26 |
| 4,908,539 | 3/1990 | Meyer | 315/169.3 |
| 4,923,421 | 5/1990 | Brodie et al. | 445/24 |
| 4,940,916 | 7/1990 | Borel et al. | 313/306 |
| 4,944,836 | 7/1990 | Beyer et al. | 156/645 |
| 4,964,946 | 10/1990 | Gray et al. | 156/643 |
| 4,999,539 | 3/1991 | Coovert et al. | 313/505 |
| 5,063,327 | 11/1991 | Brodie et al. | 313/482 |
| 5,064,396 | 11/1991 | Spindt | 445/50 |
| 5,075,591 | 12/1991 | Holmberg | 313/495 |
| 5,140,219 | 8/1992 | Kane | 313/495 |
| 5,150,192 | 9/1992 | Greene et al. | 357/68 |
| 5,191,217 | 3/1993 | Kane et al. | 250/423 F |
| 5,209,687 | 5/1993 | Konishi | 445/6 |
| 5,210,462 | 5/1993 | Konishi | 313/495 |
| 5,210,472 | 5/1993 | Casper et al. | 313/349 |
| 5,214,347 | 5/1993 | Gray | 313/355 |
| 5,216,324 | 6/1993 | Curtin | 313/495 |
| 5,231,606 | 7/1993 | Gray | 365/225.6 |
| 5,232,549 | 8/1993 | Cathey et al. | 456/633 |
| 5,233,263 | 8/1993 | Cronin et al. | 313/309 |
| 5,266,155 | 11/1993 | Gray | 156/651 |
| 5,277,638 | 1/1994 | Lee | 445/24 |
| 5,281,890 | 1/1994 | Kane | 313/309 |

(List continued on next page.)

OTHER PUBLICATIONS

K. R. Shoulders "Microelectronics Using Electron–Beam–Activated Machining Techniques" in F. L. Alt (Ed.) Advances in Computers vol. 2, N.Y., Academic Press, 1961 pp. 135–197.

(List continued on next page.)

*Primary Examiner*—Kenneth J. Ramsey
*Attorney, Agent, or Firm*—Theodore R. Touw

[57] ABSTRACT

A lateral-emitter field emission device has a thin-film emitter cathode 50 which has thickness of not more than several hundred angstroms and has an edge or tip 110 having a small radius of curvature. To form a novel display cell structure, a cathodoluminescent phosphor anode 60 is positioned below the plane of the thin-film lateral-emitter cathode 50, allowing a large portion of the phosphor anode's top surface to emit light in the desired direction. An anode contact layer contacts the phosphor anode 60 from below to form a buried anode contact 90 which does not interfere with light emission. The anode phosphor is precisely spaced apart from the cathode edge or tip and receives electrons emitted by field emission from the edge or tip of the lateral-emitter cathode, when a small bias voltage is applied. The device may be configured as a diode, triode, or tetrode, etc. having one or more control electrodes 140 and/or 170 positioned to allow control of current from the emitter to the phosphor anode by an electrical signal applied to the control electrode. In a particularly simple embodiment, a single control electrode 140 is positioned in a plane below the emitter edge or tip 110 and automatically aligned to that edge. The display cell structure may be repeated many times in an array, and the display cell structure of the invention lends itself to novel array structures which are also disclosed. A fabrication process is disclosed using subprocess steps S1–S19 similar to those of semiconductor integrated circuit fabrication to produce the novel display cell structures and their arrays. Various embodiments of the fabrication process allow the use of conductive or insulating substrates 20 and allow fabrication of devices having various functions and complexity.

24 Claims, 7 Drawing Sheets

U.S. PATENT DOCUMENTS

| | | | |
|---|---|---|---|
| 5,289,086 | 2/1994 | Kane | 315/349 |
| 5,308,439 | 5/1994 | Cronin et al. | 156/656 |
| 5,329,207 | 7/1994 | Cathey et al. | 315/169.1 |
| 5,342,477 | 8/1994 | Cathey | 156/643 |
| 5,347,292 | 9/1994 | Ge et al. | 345/74 |
| 5,374,868 | 12/1994 | Tjaden et al. | 313/310 |
| 5,382,185 | 1/1995 | Gray et al. | 445/49 |
| 5,386,172 | 1/1995 | Komatsu | 313/309 |

OTHER PUBLICATIONS

C. A. Spindt "A Thin–Film Field–Emission Cathode" J. Applied Physics vol. 39, No. 7 (1968) pp. 3504–3505.

R. F. Greene et al. "Vacuum Microelectronics" Proc. IEDM 1989, (1.3.1–1.3.5), pp. 15–19.

R. A. Lee et al., "Semiconductor Fabrication Technology Applied to Micrometer Valves" IEEE Transactions on Electron Devices, vol. 36, No. 11 (Nov. 1989) pp. 2703–2708.

H. H. Busta et al. "Lateral Miniaturized Vacuum Devices" Proc. IEDM 1989, (20.4.1–20.4.4), pp. 533–536.

J. E. Cronin et al. "Matrix Display Using Electron–Emission Devices" IBM Technical Disclosure Bulletin, vol. 32, No. 5B (Oct. 1989) pp. 239–240.

J. E. Cronin et al. "Field Emission Triode Integrated–Circuit Construction Method" IBM Technical Disclosure Bulletin, vol. 32, No. 5B (Oct. 1989) pp. 242–243.

Anonymous "Ionizable Gas Device Compatible with Integrated Circuit Device Size and Processing" reproduced from Research Disclosure No. 305 (Sep. 1989).

W. N. Carr et al. "Vacuum Microtriode Characteristics" J. Vac. Sci. Technol. vol. A8, No. 4 (Jul./Aug. 1990), pp. 3581–3585.

B. Goodman "Return of the Vacuum Tube" Discover, vol. 11, No. 3 (Mar. 1990) pp. 55–58.

S. Kanemaru et al. "Fabrication and Characterization of Lateral Field–Emitter Triodes" IEEE Transactions on electron Devices, vol. 38, No. 10 (Oct. 1991) pp. 2334–2336.

A. Kaneko et al. "Wedge–Shaped Field Emitter Arrays for Flat Display" IEEE Transactions on Electron Devices, vol. 38, No. 10 (Oct. 1991) pp. 2395–2397.

H. H. Busta, "Vacuum Microelectronics—1992" Journal of Micromechanics and Microengineering, vol. 2, No. 2 (Jun. 1992), pp. 43–74.

K. Derbyshire "Beyond AMLCDs: Field emission displays?" Solid State Technology, vol. 37, No. 11 (Nov. 1994) pp. 55–65.

| |
|---|
| FIG. 8a |
| FIG. 8b |

| |
|---|
| FIG. 9a |
| FIG. 9b |

FABRICATION PROCESS FOR A FIELD EMISSION DISPLAY CELL STRUCTURE

FIELD OF THE INVENTION

This invention relates in general to displays using integrated microelectronic devices and relates more particularly to novel display cell structures incorporating devices having a field emission cathode and to methods of fabricating such display cell structures.

BACKGROUND OF THE INVENTION

A review article on the general subject of vacuum microelectronics was published in 1992: Heinz H. Busta "Vacuum Microelectronics - 1992," Journal of Micromechanics and Microengineering," Vol. 2, No. 2 (June 1992). An article by Katherine Derbyshire, "Beyond AMLCDs: Field Emission Displays?" Solid State Technology, Vol. 37 No. 11 (Nov. 1994) pages 55–65, summarized fabrication methods and principles of operation of some of the competing designs for field emission devices and discussed some applications of field emission devices to flat-panel displays. The theory of cold field emission of electrons from metals is discussed in many textbooks and monographs, including the monograph by Robert Gomer, "Field Emission and Field Ionization" (Harvard University Press, Cambridge, Mass., 1961), Chapter 1. Field emission displays are considered an attractive alternative and replacement for liquid crystal displays, because of their lower manufacturing cost and lower complexity, lower power consumption, higher brightness, and improved range of viewing angles.

NOTATIONS AND NOMENCLATURE

Phosphor is used in this specification to mean a material characterized by cathodoluminescence. The terms emitter and cathode are used interchangeably throughout this specification to mean a field emission cathode. The term "control electrode" is used herein to denote an electrode that is analogous in function to the control grid in a vacuum-tube triode. Such electrodes have also been called "gates" in the field emission device related art literature.

DESCRIPTION OF THE RELATED ART

Microelectronic devices using field emission of electrons from cold-cathode emitters have been developed for various purposes to exploit their many advantages including high-speed switching, insensitivity to temperature variations and radiation, low power consumption, etc. Most of the microelectronic field emission devices in the related art have had emitters which point orthogonally to the substrate, generally away from the substrate, but sometimes toward the substrate. Examples of this type of device are shown, for example, in U.S. Pat. No. 3,789,471 by Spindt et al., U.S. Pat. No. 4,721,885 by Brodie, U.S. Pat. No. 5,127,990 by Pribat et al., U.S. Pat. Nos. 5,141,459 and 5,203,731 by Zimmerman, and in the above-mentioned article by Derbyshire. In such structures, the anode is typically a transparent faceplate parallel to the substrate and carrying a phosphor which produces the display's light output by cathodoluminescence. A few cold-cathode microelectronic devices have had field emitters oriented in a plane substantially parallel to their substrates, as for example in U.S. Pat. No. 4,728,851 by Lambe, U.S. Pat. No. 4,827,177 by Lee et al., and U.S. Pat. Nos. 5,233,263 and 5,308,439 by Cronin et al. The terminology "lateral field emission" and "lateral cathode" of the latter two patents by Cronin et al. will be adopted herein to refer to a structure in which the field emitter edge or tip points in a lateral direction, i.e. substantially parallel to the substrate. In such lateral cathode structures of the prior art the anode is oriented substantially orthogonally to the substrate and to the emitter (as in U.S. Pat. Nos. 5,233,263 and 5,308,439 by Cronin et al.), or is coplanar with the emitter (as in U.S. Pat. No. 4,827,177 by Lee et al.), or requires a transparent substrate (as in U.S. Pat. No. 4,728,851 by Lambe). Some device structures and fabrication processes using lateral cathode configurations have been found to have distinct advantages, such as extremely fine cathode edges or tips and precise control of the inter-element dimensions, alignments, capacitances, and required bias voltages.

PROBLEMS SOLVED BY THE INVENTION

If lateral field emission devices are used in a display cell with phosphor-coated anodes, a number of problems occur. In some of the prior art structures, the cathodoluminescence occurs only at a very narrow region at an edge of the anode facing the lateral emitter. In others the light emitted from the phosphor can be obscured by opaque electrodes or absorbed in the phosphor layer itself or in a faceplate. In some prior art structures very high anode voltages must be used. For low voltage electron field emission device display elements (e.g. with anode potentials of less than about 10 volts with respect to the emitter), the actual electron penetration into the phosphor is on the order of 1 nanometer. Therefore, in displays using prior art lateral electron field emission device display elements, the light emission due to cathodoluminescence occurs along the edge of the phosphor facing the emitter element. Furthermore, other electron field emission displays such as the Spindt type (described in the patent by Spindt et al. and in the review article by H. H. Busta cited herein above) typically emit light at a phosphor surface which is opposite the phosphor surface facing the observer.

The device structure described herein has a lateral electron emitter situated a distance above the anode phosphor. With an appropriate applied bias, the emitted electrons spread out over the top surface of the phosphor and impinge over a wider area of the phosphor element than with other lateral electron field emission device display elements. Hence, with this new structure, the light is emitted in direct view of the observer and is not attenuated by passing through the phosphor as is the case with prior art structures. Also, the light is generated over a larger portion of the cell area than in prior art structures.

The prior art descriptions of lateral-emitter field emission display elements do not show how to provide a bias voltage contact to the phosphor of such an anode element. The new structure described herein has a metal anode contact situated below the phosphor ("buried") and also may have means for connecting to that buried contact from the surface for applying electrical bias. Thus the present invention solves several problems of the prior art.

OBJECTS AND ADVANTAGES OF THE INVENTION

An important object of the invention is providing a display with improved light emission from each cell of the display. A related object is a field emission device structure specially adapted for use in a display cell. Another related object is a field emission display which allows light emitted from a phosphor to be aimed more directly toward the viewer of the display. Another related object is a field emission display cell structure in which the light emission area occupies a larger portion of the cell area than in prior art devices of the lateral-emitter type. Another object of the invention is a metallization structure that allows the other features and advantages of an improved lateral-emitter field emission display device to be realized. A particular object is an anode electrical contact structure that does not obscure any portion of a phosphor surface of a display cell. A related object is an anode contact that can act as a mirror to reflect emitted light toward the observer of the display. Another object is a display cell anode structure that provides improved performance with coulombic aging of the phosphor thereby being reduced or eliminated. Another particular object is a display cell simplified by having a control electrode configuration that may be made with a single metallization step. An overall object of the invention is an improved display which nevertheless retains all the known advantages of lateral-emitter field emission devices, including the following: extremely fine cathode edges or tips; exact control of the cathode-to-anode distance (to reduce device operating voltage and to reduce device-to-device variability); exact control of the cathode-to-control-electrode distance (to control the control-electrode-to-cathode overlap, and thereby control the inter-electrode capacitances and more precisely control the required bias voltage); inherent alignment of the control-electrode and cathode structures; self-alignment of the anode structure to the control-electrode and cathode; and improved layout density. Another object of the invention in retaining known advantages of lateral-emitter field emission devices is the significant design flexibility provided by an integrated structure which reduces the number of interconnections between devices, thus reducing costs and increasing device reliability and performance. Another important object of the invention is a process using existing microelectronic fabrication techniques and apparatus for making integrated lateral-emitter field emission display device cell structures with economical yield and with precise control and reproducibility of device dimensions and alignments.

SUMMARY OF THE INVENTION

In a basic embodiment of the present invention, a novel lateral-emitter rectifying device is provided in which a phosphor anode is positioned below the plane of the emitter by a predetermined distance and is contacted by a buried anode contact. As in other lateral-emitter devices in the prior art, the device of the present invention includes a cathode whose thickness is not more than several hundred angstroms, which extends parallel to the upper surface of a substrate, and which includes an edge or tip for emitting electrons by field emission. The anode is spaced apart from the cathode edge or tip by a predetermined distance and receives electrons emitted by field emission from the edge or tip of the cathode. With a small cathode edge or tip to anode spacing, the field emission device is capable of operation at a low voltage. In a simple embodiment of the present invention, the anode phosphor upper surface is substantially parallel to the substrate's upper surface. Unlike earlier low-voltage lateral-emitter devices, a major portion of the anode phosphor that is active in emitting light when its cathodoluminescence is excited by electrons from the emitter is oriented to be readily seen by an observer of the display.

The rectifying device may be configured as a diode or may be configured as a triode, tetrode, etc. having one or more control electrodes positioned to allow control of current from the emitter to the phosphor by an electrical signal applied to the control electrode. Improved metallization means are provided for applying electrical voltages to the cathode, to the control electrodes if any, and to the anode. As in some earlier lateral-emitter devices, the anode is preferably self-aligned to the emitter and to the control electrodes if any. In the triode configuration, the emitter and control electrodes preferably terminate in a common plane that is substantially orthogonal to the upper surface of the substrate, thus also being self-aligned. In a particularly simple embodiment of the triode configuration, a single control electrode is positioned in a plane below the plane of the emitter edge or tip. In another embodiment two control electrode elements are positioned one above and one below the emitter edge or tip.

In all the configurations of the rectifying device of the present invention, the space between the cathode and anode and the space above the anode can comprise a vacuum or can contain a gas. As in some prior art lateral-emitter devices, a plurality of spaced-apart cathodes may be disposed vertically (stacked) relative to a supporting substrate. In that case, each of the cathodes has an edge or tip at one end for emitting electrons by field emission, and all of the cathode edges or tips are substantially aligned in the same general direction. Similarly, a plurality of control electrodes may be included in each device. The plurality of control electrodes may also be disposed in a stacked arrangement and in particular may be disposed between the stacked cathodes. Electrical connections are made to each electrode by conductive metallization, and in various embodiments at least some of the control electrodes are electrically interconnected and/or at least some of the cathode members are electrically interconnected. In another aspect of the invention, multiple lateral-emitter field emission devices may be integrated into arrays to form display structures in various arrangements, using known interconnection schemes to allow selective illumination of the phosphor of individual devices made in accordance with the invention. However, the novel structure of individual field emission devices made in accordance with the invention also makes possible novel interconnection schemes that go beyond those known in the art, to make arrays in preferred embodiments described in detail herein. One such array has long parallel anodes extending in a first direction and has emitter edges or tips aligned along a second direction facing both edges of each anode, with triode structures and interconnections such that light emission adjacent to each emitter edge may be individually controlled by its respective control electrode.

In another aspect, the present invention comprises improved methods for fabricating a field emission display device. In one basic embodiment, the fabrication method for a diode device includes the steps of: providing a flat substrate; disposing a first metallic layer on the upper surface of the substrate to form a buried anode contact; overlaying a first insulating layer on the first metallic layer; disposing an ultra-thin second metallic layer over the first insulating layer to form an emitter layer; providing an opening through the second metallic layer and the first insulating layer; disposing a conformal layer of material of predetermined thickness within the opening; directionally etching the conformal layer material to form spacers within the opening; filling the opening at least partially with a phosphor layer such that the spacers of the conformal layer exactly space the phosphor layer from the second metallic layer in order to form a phosphor layer extending from the buried anode layer to a plane below the emitter layer; and providing metallization for applying electrical bias voltage to the buried anode layer and to the emitter layer, the bias voltage to be applied having suitable polarity and sufficient amplitude to cause cold-cathode electron emission from the ultra-thin emitter layer to the phosphor layer. Various embodiments of the fabrication method are also described herein, including some which start with a conductive substrate instead of an insulating substrate to provide a common anode for a number of integrated field emission devices, thereby allowing the substrate to perform the function of a buried anode contact layer and making disposition of a first metallic layer on the upper surface of the substrate unnecessary for diode or triode structures.

DETAILED DESCRIPTION OF THE PREFERRED EMBODIMENTS

Figure 1A:
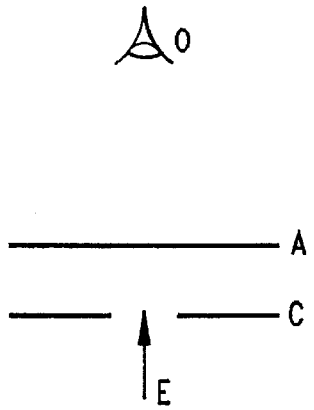
FIG. 1a PRIOR ART
FIGS. 1*a*–1*c* show schematic representations of various field emission microelectronic devices known in the prior art.
Figure 1B:
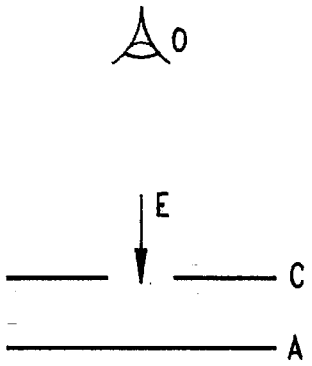
FIG. 1b PRIOR ART
Figure 1C:
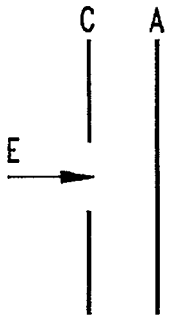
FIG. 1c PRIOR ART

In order to clearly describe the preferred embodiments of the present invention, it is helpful to compare the invention with various configurations known in the prior art. FIGS. 1*a*–1*c* therefore show schematic representations of various field emission microelectronic devices known in the prior art. (These figures correspond to FIGS. 19*a*–19*c* of U.S. Pat. Nos. 5,233,263 and 5,308,439 by Cronin et at., with elements re-labeled to correspond to the terminology of the present specification.) In FIGS. 1*a*–1*c*, reference letter A represents an anode element, reference letter E represents a field emission cathode emitter, reference letter C represents a control electrode, and reference letter O represents the eye of an observer of a display, to show the direction from which the display is viewed. FIG. 1*a*, with the emitter pointing toward the observer's direction, has been referred to as an "emitter-up" configuration. FIG. 1*b*, with the emitter pointing away from the observer's direction, has been referred to as an "emitter-down" configuration. While "up" and "down" have no connotation relating to the orientation of a display with respect to the direction of gravity, they are convenient terms used in designating the directions shown in the figures. FIG. 1 c, with the emitter pointing laterally with respect to the observer's line-of-sight, is a lateral cathode configuration as in the prior art.

Figure 2A:
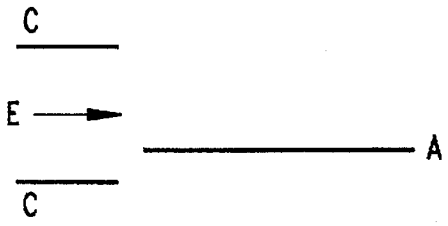
FIGS. 2*a*, 2*b* and 2*c* show schematic representations of lateral-emitter rectifying devices made in accordance with the present invention.
Figure 2B:
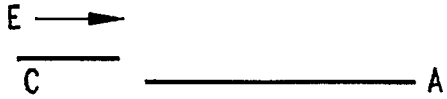
Figure 2C:
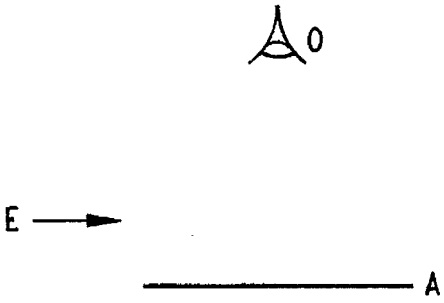

FIGS. 2*a*, 2*b*, and 2*c* show schematic representations of lateral-emitter rectifying devices made in accordance with the present invention, with reference letters as above designating corresponding elements now arranged in novel configurations. The emitter E of both FIGS. 2*a* and 2*b* is a lateral emitter as in FIG. 1*c*, but the anode A of FIGS. 2*a* and 2*b* is arranged below the plane of emitter E, allowing electrons emitted from lateral emitter E and attracted to anode A by an electric field to hit the entire upper surface of anode A or at least a major portion of that upper surface. Furthermore, anode A in FIGS. 2*a* and 2*b* is oriented so that the upper major surface of anode A intersects substantially orthogonally the line-of-sight from an observer O, while retaining all of the advantages of a lateral emitter E. FIG. 2*a* and FIG. 2*b* differ in that FIG. 2*a* has a substantially symmetric arrangement of elements of control-electrode C similar to that of FIG. 1*c*, while FIG. 2*b* has a novel configuration with a single-element control electrode C disposed generally parallel to lateral emitter E, in an asymmetric configuration having advantages of simpler and less expensive fabrication and being readily adapted to the lateral emitter construction of field emission devices. It will be apparent that a diode structure may be made by omitting control electrode C from any of the configurations of FIGS. 1*a*–1*c*, or from either of the configurations of FIGS. 2*a*–2*b*. This is shown in FIG. 2*c*.

Figure 3:
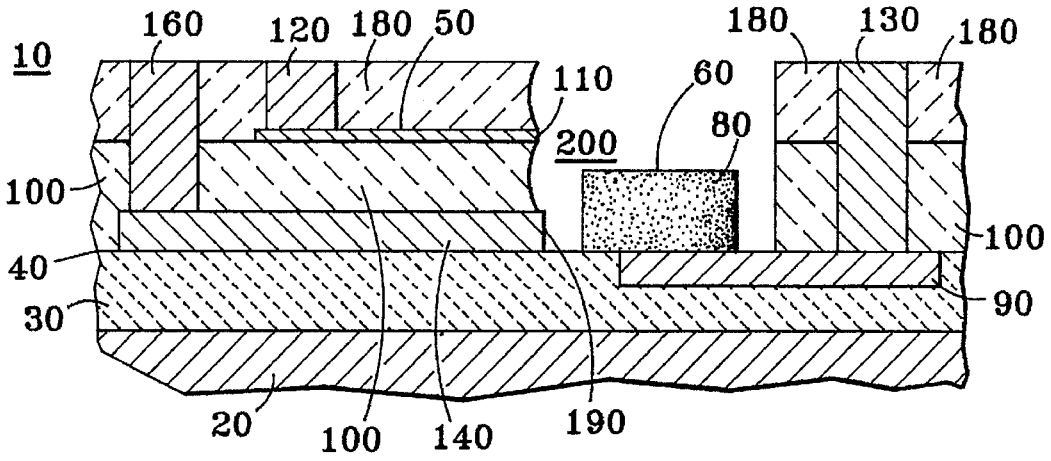
FIG. 3 shows an elevation view in cross-section of a display cell structure made in accordance with the invention.

In the following description of the preferred embodiments, references are made to the drawings in which the same reference numbers are used throughout the various figures to designate the same or similar components. It should be noted that the drawings are not drawn to scale. In particular, the vertical scale of cross-sections is greatly exaggerated for clarity, and thicknesses of various films are not drawn to a uniform scale. FIG. 3 shows an elevation view in cross-section of a preferred embodiment of a display cell structure made in accordance with the invention, and FIG. 4 shows a plan view of that preferred embodiment of a display cell structure.

As illustrated in FIG. 3, the display cell structure, generally denoted 10, is made on a flat starting substrate 20. A flat silicon wafer is a suitable starting substrate, but the starting substrate may be a flat insulator material such as glass, $Al_2O_3$ (especially in the form of sapphire), silicon nitride, etc.. If starting substrate 20 is not an insulator, a film of insulating material 30 such as silicon oxide may be deposited to form an insulating substrate. Alternatively, a conductive substrate may be used as a common anode in some embodiments. If the starting substrate 20 is an insulator, then a separate film of insulating material 30 is not needed, and the top surface of starting substrate 20 is identical to the top surface of insulating material 30. In either case, the top surface of insulating material 30 defines a reference plane 40 from which the positions of other elements of the structure may be referenced or measured. The structure also has an emitter 50 and an anode denoted generally by 60. Emitter 50 is a lateral field emission cathode, an ultra-thin metal layer described in more detail below, placed on a plane spaced above reference plane 40. Anode 60 comprises a layer of phosphor 80 on the top surface of a buried anode contact layer 90. Buried anode contact layer 90 makes ohmic electrical contact with anode 60, and is preferably made substantially parallel to reference plane 40, with either its upper surface, or its lower surface, or a plane between the two being substantially coplanar with reference plane 40. In the preferred embodiment of FIG. 3, buried anode contact layer 90 is made recessed into insulating surface 30, and with its top surface substantially coplanar with reference plane 40. In the preferred process (described in detail below) for forming buried anode contact layer 90, a recess is formed in the insulating surface 30 and the recess is filled with metallization to form anode contact 90. Buried anode contact layer may extend under part of anode 60 as shown in FIG. 3, or under the entire lower side of anode 60 for some purposes (such as acting as a mirror for light emitted from phosphor 80). A first insulating layer 100 selectively placed between the plane of buried anode contact layer 90 and the plane of emitter 50 insulates buried anode contact layer 90 from the electron emitter 50.

Emitter 50 has an emitter edge or tip 110 from which electrons are emitted by field emission when the display cell structure is operated with appropriate electrical bias voltage (anode positive). Anode 60 is spaced apart laterally from the edge or tip 110 of electron emitter by a first predetermined lateral distance and extends upward from buried anode contact layer 90 to a height less than the distance between reference plane 40 and emitter 50. This places the top surface &anode 60 below the plane of lateral emitter 50. When the display cell structure is used in its display function, anode 60 comprises a phosphor layer 80, and it is the top surface of phosphor layer 80 that is positioned below the plane of emitter 50. It has been found, in using devices made with a relatively thin film of phosphor for phosphor layer 80, that this anode structure exhibits improved performance by reducing or eliminating coulombic aging of the phosphor.

Figure 4:
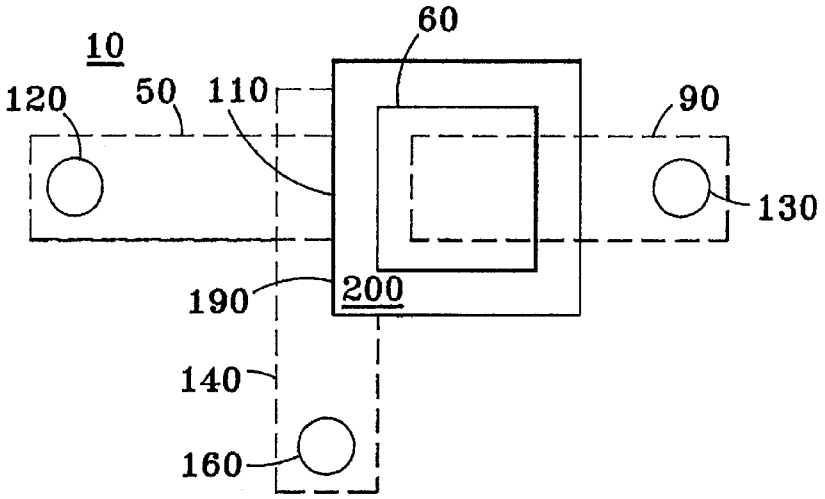
FIG. 4 shows a plan view of a preferred embodiment of a display cell structure.

The predetermined gap distance between emitter edge or tip 110 and anode 60 is determined by the width of space 100 shown in FIGS. 3 and 4. The space 200 between the cathode and anode and the space above anode 60 can comprise a vacuum or can contain a gas. A process for making a structure enclosing space 200 is described herein below.

The display cell structure shown in FIGS. 3 and 4 also has conductive contact 120 connected to electron emitter 50 to provide a cathode contact. Similarly, conductive contact 130 connects to buried anode contact layer 90 to provide an anode contact. These two conductive contacts 120 and 130 are spaced apart and insulated from each other by intervening portions of the various insulating layers. The conductive contacts 120 and 130 are used to apply electrical bias voltages to the respective electrodes. The display cell structure may also have conventional contact pads (not shown in the figures) connected to the anode and cathode conductive contacts for external electrical connections. The display cell may have a conventional passivation layer of insulator selectively covering the cell's top surface except at the contact pads.

Emitter 50 is preferably formed by depositing an ultra-thin film of a conductor with low work function for electron emission, preferably 100–200 Angstroms in thickness. Preferred emitter materials are titanium, tungsten, titanium-tungsten alloy, tantalum, or molybdenum, but many other conductors may be used, such as aluminum, gold, silver, copper, copper-doped aluminum, platinum, palladium, polycrystalline silicon, etc. For some applications, transparent thin film conductors such as tin oxide or indium tin oxide (ITO) are especially useful. For such applications, it is even possible to make the entire device of substantially transparent materials. The design of the present invention, with a phosphor layer that may be so thin as to be substantially transparent, is especially adaptable for this purpose. Such a construction can be used, for example, to augment a visual field viewed through the device, with imagery, graphics, or text superimposed on the field of view.

So far in this description of the display cell structure of FIGS. 3 and 4, the device as described has been suitable for electrical operation as a diode, with lateral field emission cathode 50 and anode 60. This is the simplest type of rectifying device formed in the display cell structure. To form a triode from this diode structure, a conductive control electrode 140 is placed in the region near emitter 50 and anode 60 to control the electron current flowing to anode 60. In the preferred embodiment of FIGS. 3 and 4, control electrode 140 is a metal film positioned in a plane between the reference plane 40 and the plane upon which emitter 50 is made, spaced below the emitter plane. Control electrode 140 is preferably made directly on reference plane 40 and patterned to be spaced from buried anode contact 90 as shown in FIGS. 3 and 4. Control electrode 140 is isolated from electrical contact with emitter 50 and anode 60. In the display cell structure it is spaced apart laterally from anode 60 by a predetermined distance. In a preferred process of fabricating the display cell structure, control electrode 140 is self-aligned with emitter edge or tip 110, which is also spaced apart laterally from anode 60 by a predetermined distance. First insulating layer 100 insulates control electrode 140 from emitter 50. A third conductive contact 160 (spaced from conductive contacts 120 and 130) is connected to control electrode 140. When the emitter 50 and anode 60 are biased to extract electrons from emitter edge or tip 110 to anode 60, and when an appropriate electrical signal is applied to control electrode 140, the device operates as a triode. A positive voltage of sufficient amplitude with respect to emitter 50 applied to control electrode 140 can produce a high enough electric field at emitter edge or tip 110 of emitter 50 to cause field emission current, allowing control electrode 140 to operate as an extraction electrode. With respect to the particular aspect of control electrode arrangement the triode rectifying device just described can be characterized as an "asymmetric control electrode" device or as a "lateral control electrode" device based on its configuration with one control electrode made parallel to the lateral emitter. This triode rectifying device corresponds to the schematic representation in FIG. **2*b*. For clarity of illustration control electrode 140 is shown in the cross-section of FIG. 3 extending in a direction parallel to emitter 50. However a preferred design is shown in the plan view of FIG. 4, where control electrode 140 extends substantially orthogonally to emitter 50 in plan view, and conductive contact 160 for control electrode 140 is not necessarily aligned in a plan view with conductive contact 120 for emitter 50. FIG. 4 shows clearly that space 200 between anode 60 and both emitter 50 and control electrode 140 has a common edge with emitter 50 and control electrode 140, so that the latter elements are automatically- or self-aligned by the formation of space 200**.

Figure 5:
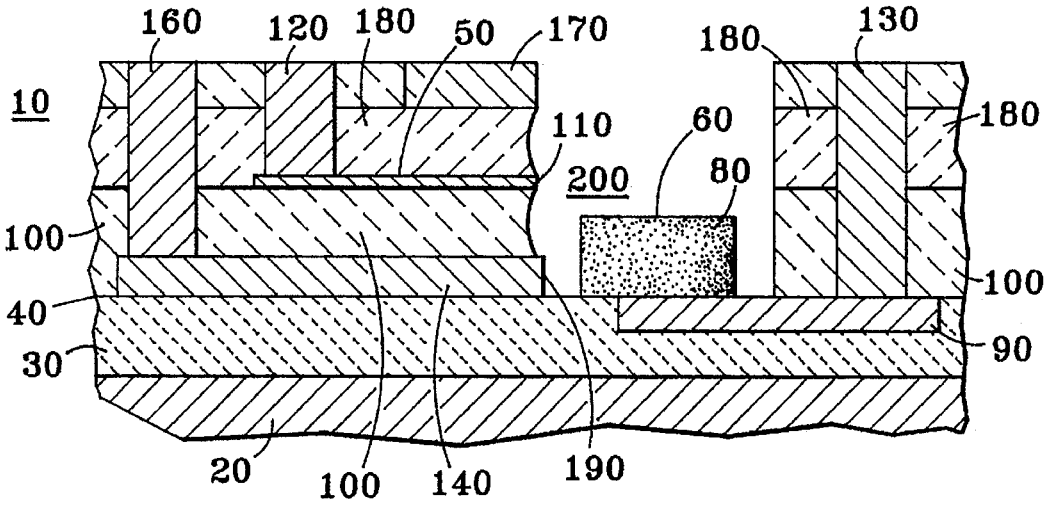
FIG. 5 shows an elevation view in cross-section of a display cell structure having more than one control electrode.

A display cell structure corresponding to the schematic representation of FIG. **2*a* may also be made, which has a control electrode substantially symmetric with respect to the lateral emitter in the vertical direction. Such a configuration is shown in FIG. 5, which has a second control electrode element 170 spaced above emitter 50. An insulating layer 180 insulates second control electrode 170 from emitter 50. While control electrode element 170 is shown in FIG. 5 spaced above emitter 50 by a distance equal to the spacing between emitter 50 and control electrode 140, this geometric symmetry may be modified in some embodiments to have unequal spacings in order to compensate for the vertically asymmetric relationship of anode 60 with respect to the axis of emitter 50. The two control electrodes 140 and 170 may be electrically common for the simplest configuration. However, like the geometric symmetry between the two control electrodes, this may be modified in some embodiments to have separate electrical control signals applied to control elements 140 and 170. Thus, even with a geometrically symmetric arrangement of control electrodes, which simplifies the fabrication process for the structure of FIG. 5, separate electrical control of control electrodes 140 and 170 may be used to adjust for the emitter/anode geometric asymmetry. To reiterate the relationship between the embodiments of FIGS. 3 and 4 on the one hand and of FIG. 5 on the other hand, the embodiment of FIGS. 3 and 4 corresponds to that of FIG. 5, with only the second control electrode 170 omitted. Similarly, the relationship between the triode configurations of FIG. 3 and 5 and the corresponding diode configurations (not shown) is such that the diode configurations omit both control electrodes 140 and 170**. Thus various functional devices are made using the same basic lateral emitter display cell structure, by including or omitting particular elements.

While the display cell structure has been described in terms of configurations for use in a field emission display, the same structures with small modifications can be used simply as diodes and triodes for switching functions or amplification. It will be apparent to those skilled in the art that the same diode and triode structures described herein having phosphor anodes may also be made advantageously with anodes of conductive materials but without phosphor to simply perform the functions of diodes and/or triodes within the circuitry of the same overall display apparatus. The fabrication process may be varied in detail to accommodate these differences in anode material, in some cases merely by omitting a phosphor deposition or by masking those devices to which phosphor is not to be applied. It is recognized that a configuration in which the anode extends generally parallel to the direction that electrons are emitted from a cathode is likely to have some additional spread in electron transit times, in comparison with configurations having the anode generally orthogonal to the emission direction, as in the prior art. However this effect is not expected to be significant with the very small anode dimensions at which the display cell structure of this invention is expected to find its greatest usefulness. In these applications, the speed of operation is dominated by inter-electrode capacitances.

For some purposes it may be desirable to make the top of anode 60 higher than the emitter plane, as high as the top surface of insulator 180, or even higher. Such a construction retains the advantages of having a buried anode contact 90. If anode 60 is made of a conductor that is not also a phosphor, the field emission device may be used without light emission as a simple diode, triode, or tetrode, etc. as described above. With the higher anode design, the electron transit time spread effect mentioned above is substantially eliminated.

It should be noted that the emitter 50 has an emitting edge oriented toward anode 60, as shown in the embodiments of both FIG. 3 and FIG. 5. That edge comprises the emitter edge or tip 110, which is made to have a very small radius of curvature (preferably less than 0.05 micrometer and even more preferably less than 0.01 micrometer) to achieve field emission at low bias voltages. Because emitter 50 is made by depositing an ultra-thin layer of only several hundred Angstroms thickness, the radius of curvature is automatically small. As is well known in the art, the emitter-tip radius of curvature required depends on a number of factors, including the work function of the emitter material, the bias voltage and the current desired, and the physical dimensions of the field emission device. Similarly, control-electrodes 140 and/or 170 each have an edge oriented toward anode 60. It is desirable in field emission devices to have the spacings between these edges (emitter to anode, emitter to control electrode, and control electrode to anode) be uniform, reproducible, and precisely made to pre-determined dimensions. For the devices of this invention, these features are achieved by the use of standard semiconductor microelectronic fabrication techniques (described in detail below) and apparatus, and by self-aligning characteristics of the display cell structure. These are known features of the lateral-cathode type of field emission microelectronic device, which have been adapted for the particular novel cell structure of this invention. The predetermined lateral distances from emitter edge or tip 110 to anode 60 and from the edge of control electrode 140 (and/or 170) to anode 60 are made substantially equal, and the emitter edge or tip 110 is vertically aligned to the edge of control electrode 140 (and/or 170) to make the preferred device cell structures of FIGS. 3 and 5.

Figure 6:
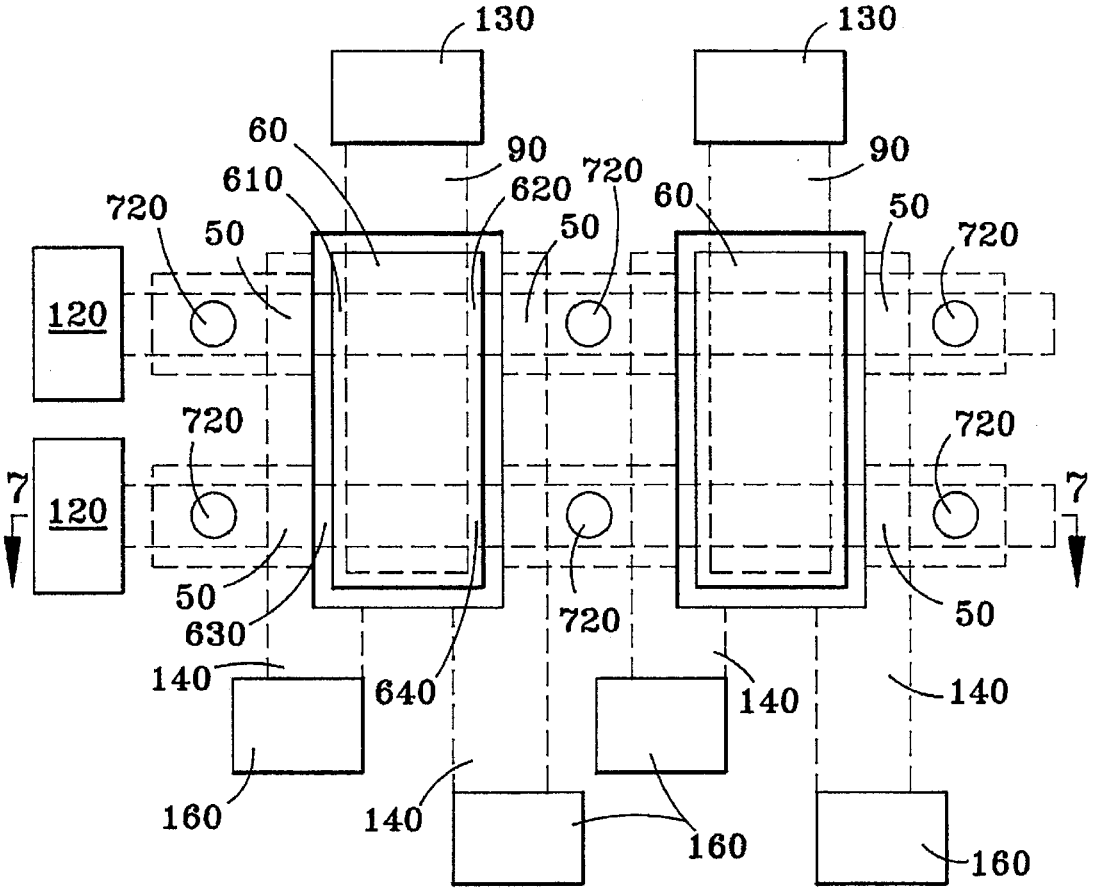
FIG. 6 shows a plan view of an embodiment of an array of display cells.
Figure 7:
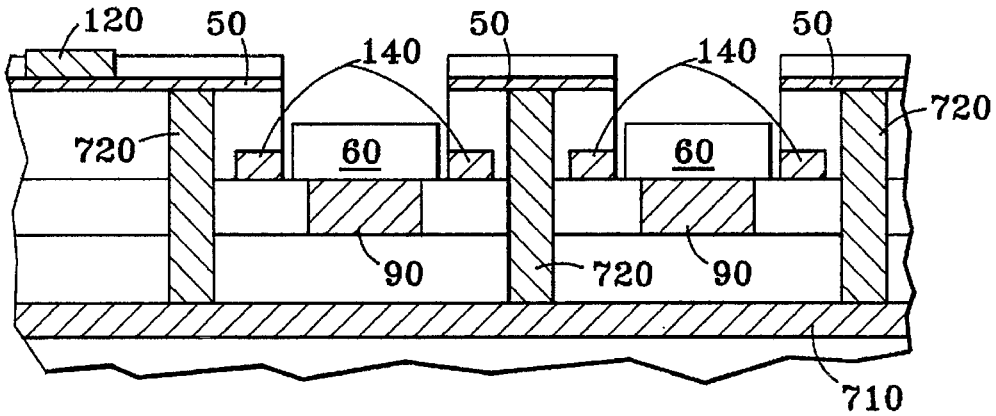
FIG. 7 shows an elevation view in cross-section of the array embodiment of FIG. 6.

FIG. 6 shows a plan view of a preferred embodiment of an array of display cells. FIG. 7 shows an elevation view in cross-section of the array embodiment of FIG. 6. The array of FIG. 6 has a novel cell arrangement made practical by the field emission device of the present invention. For clarity, only a few field emission devices are shown in FIG. 6. It will be apparent that the same interconnection scheme can be repeated indefinitely in both X and Y directions. In FIG. 6, the anodes 60 extend vertically across a number of horizontal rows of lateral emitters 50. Columns of control electrodes 140 extend vertically (parallel to the anodes) across the same horizontal rows of lateral emitters 50. In a given horizontal row, two lateral emitters 50 can deliver current to each anode, one on each anode edge (vertical in FIG. 6). As illustrated more clearly in the cross sectional view of FIG. 7, the lateral emitters of a row are interconnected by a buried emitter contact level 710 via emitter contacts 720 connected to each emitter 50. The same two lateral emitters may be controlled by two independent control electrodes 140. Thus two edges of an anode 60 are independently addressable where each emitter row crosses. This is not the case in a diode array configuration (similar to FIG. 6 but with all control electrodes 140 omitted). In that diode array configuration, both sides of the same anode are excited to emit light. Typical locations (pixels) where the electrons from emitter edges can excite cathodoluminescence on anodes 60 are shown in FIG. 6 by reference numerals 610, 620, 630, and 640, which, with the particular dimensions of FIG. 6, are arranged as the corners of a rectangle.

Not shown explicitly in FIG. 6 is a particularly preferred arrangement where the pitch between two successive emitter rows is the same as the width of electrodes 60, and two adjacent anodes 60 are spaced apart by a distance equal to the anode widths. Since the two edges of each anode 60 are also spaced apart by the width of the anode, this forms a regular square array of light emitting pixels with equal spacings vertically and horizontally. Thus in this preferred arrangement the pixel locations 610, 620, 630, and 640 form a square.

Each pixel of the array of FIG. 6 is independently addressable. In a triode array as shown, each pixel may be controlled by selecting an emitter row and a control electrode column. In a diode array, the pixels are addressed by switching emitter biases of a row and anode biases of a column, and two horizontally adjacent pixels are illuminated for each address.

Figure 8A:
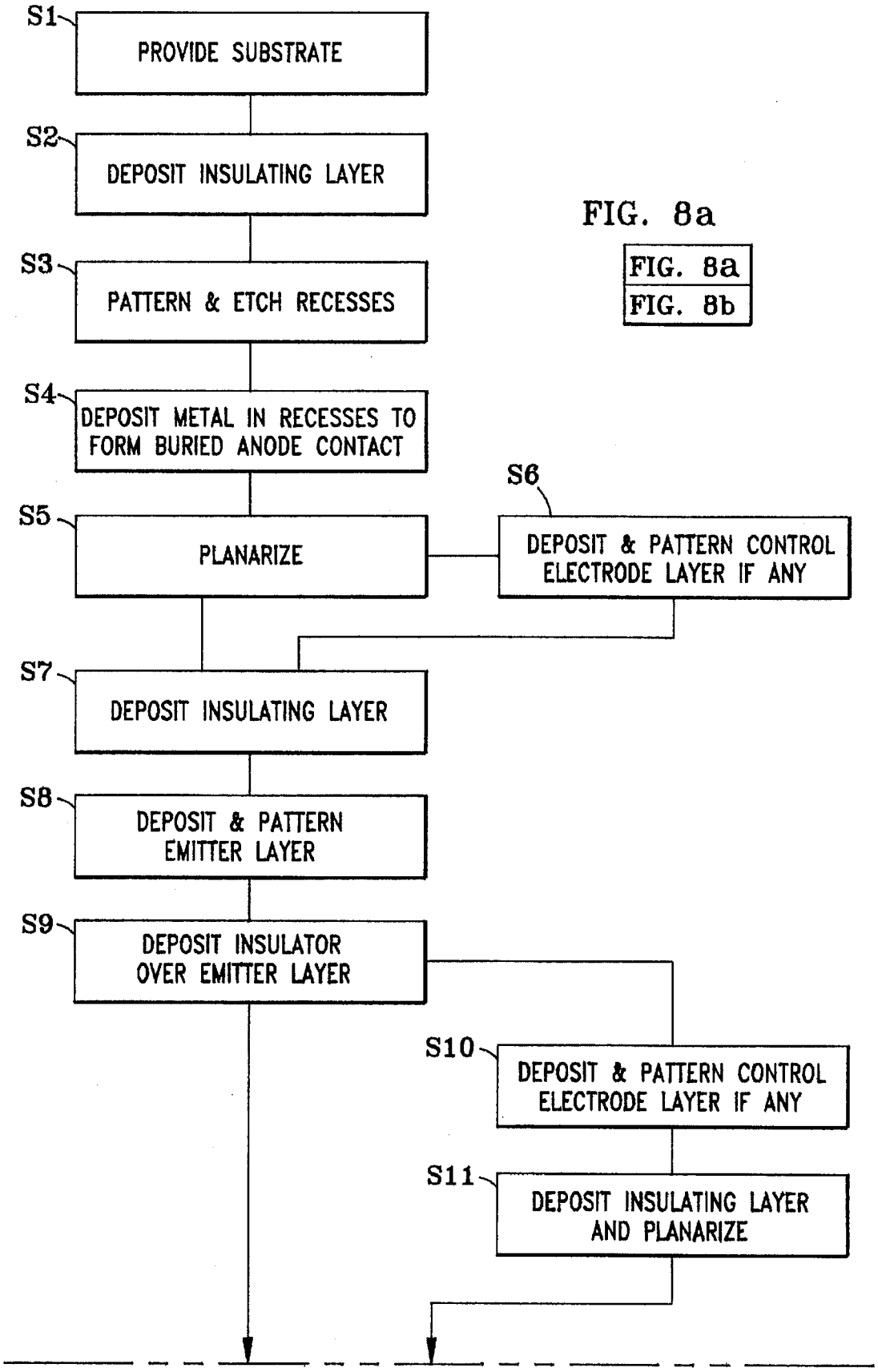
FIGS. 8*a* and 8*b* together show schematically a flow diagram illustrating a preferred embodiment of a fabrication process performed in accordance with the invention.
Figure 8B:
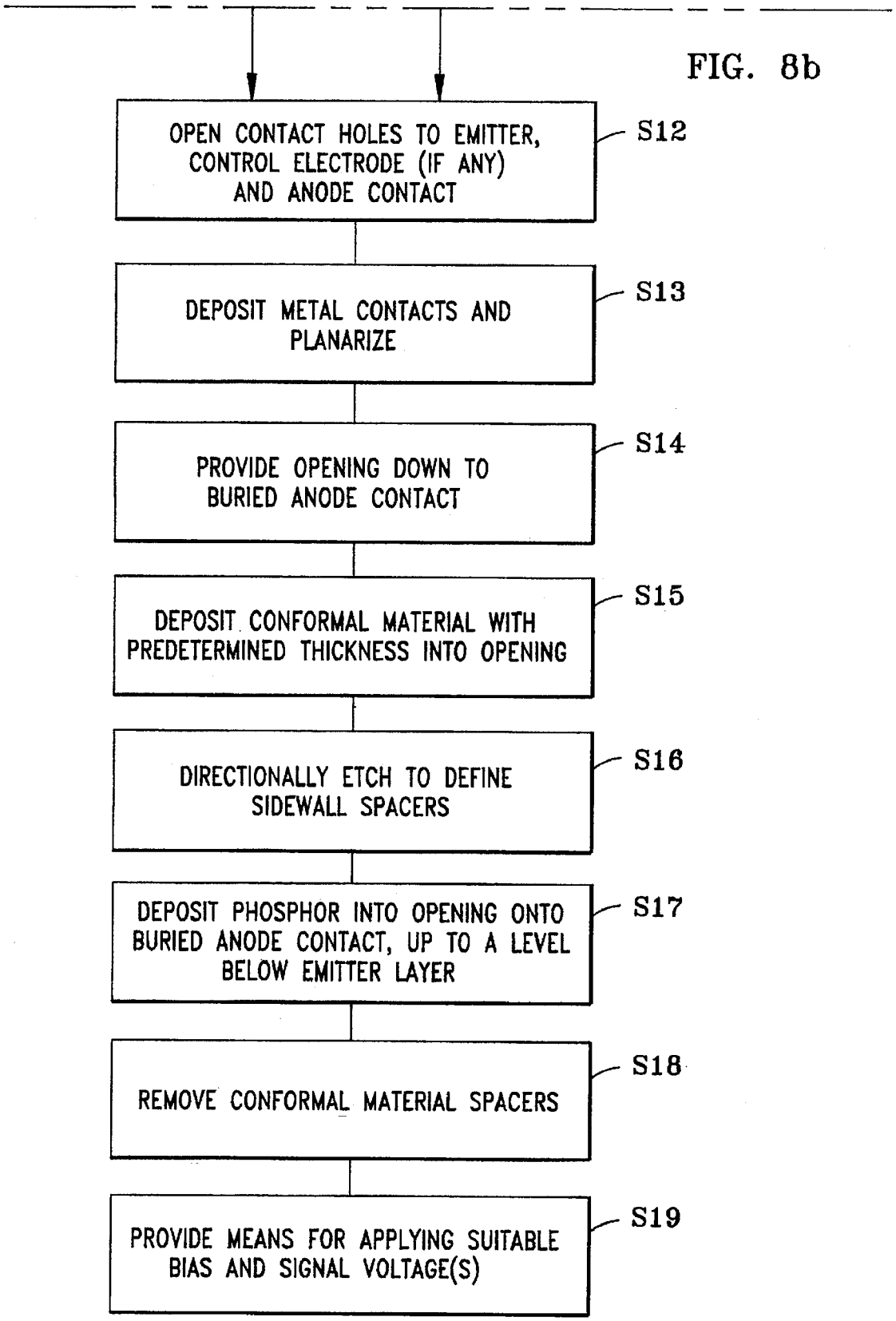
Figure 9A:
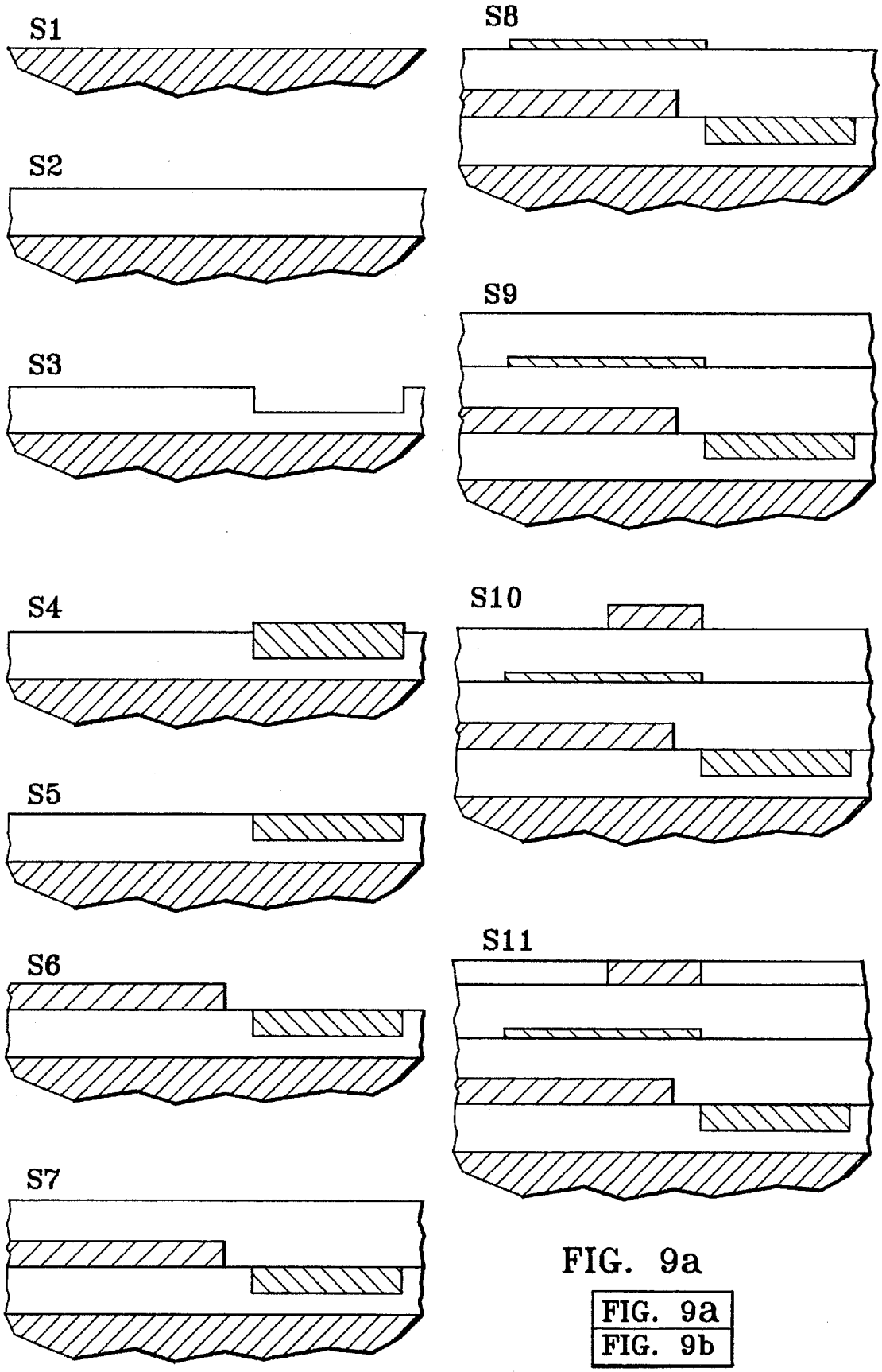
FIGS. 9*a* and 9*b* together show a sequence of cross sectional views of a display cell at various stages of the fabrication process depicted in FIGS. 8*a* and 8*b*.
Figure 9B:
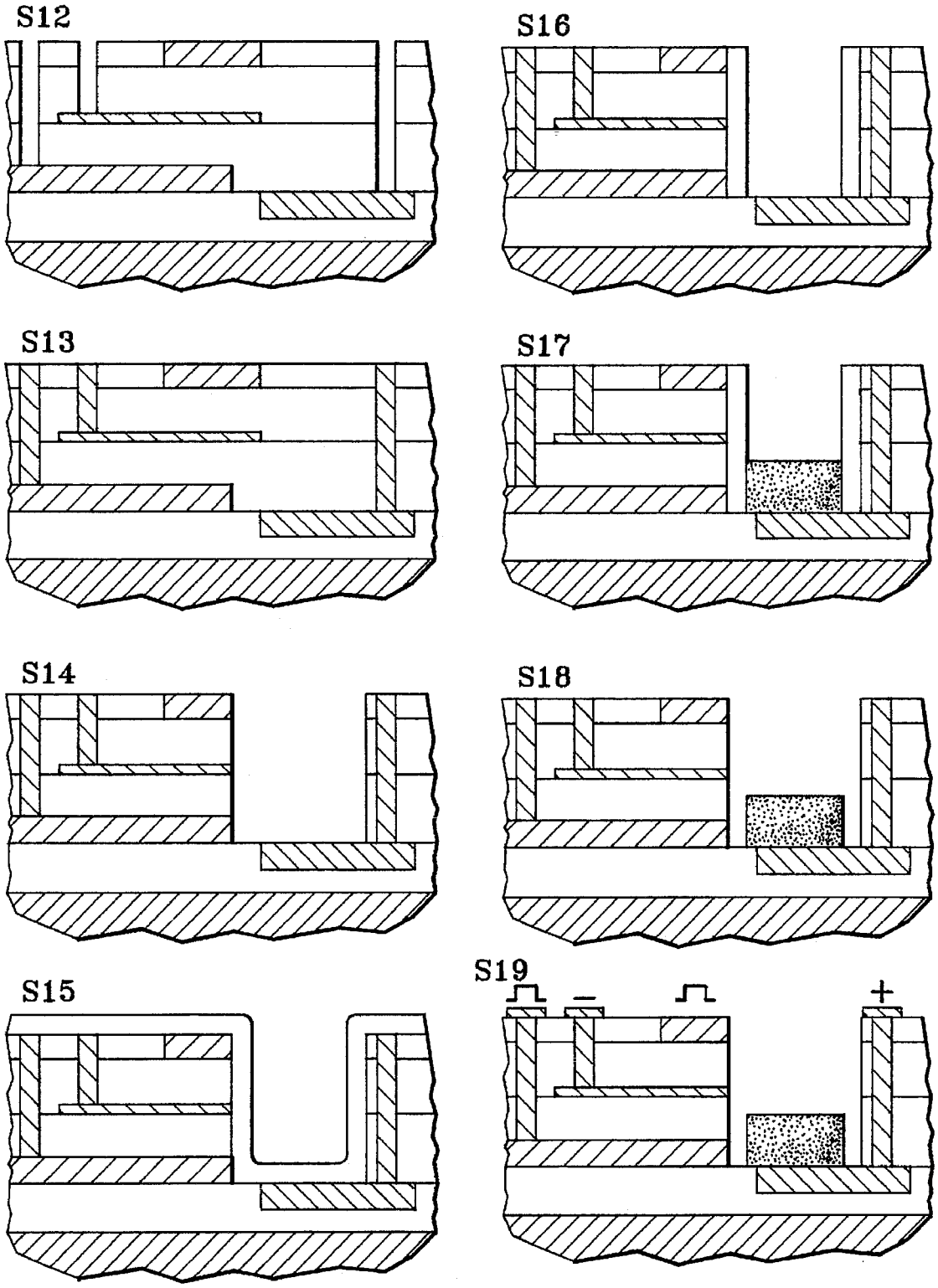

FIGS. 8*a* and 8*b* together show schematically a flow diagram illustrating a preferred embodiment of a fabrication process performed in accordance with the invention, with step numbers indicated by references S1, etc.. FIGS. 9*a* and 9*b* together show a sequence of cross sectional views of a display cell at various stages of the fabrication process depicted in FIGS. 8*a* and 8*b*. Each cross section of FIGS. 9*a* and 9*b* shows the result of the process step indicated next to the cross section. (The identities and functions of individual elements in the cross sections of FIG. 9*a* and 9*b* will be apparent by comparison with FIG. 5) The detailed process illustrated is a process for a triode (or tetrode) device with two control electrodes. It will be apparent to those skilled in this art that analogous processes may be practiced to fabricate triodes with one control electrode, or diodes with no control electrode, by omitting appropriate steps of the process illustrated in the drawing and described herein. An overall outline of a fabrication process for a simple diode device structure is described first, referring to corresponding process steps (indicated by reference numbers S1, etc.) of the more detailed process, followed by a detailed description of the process for more complex devices. Reference numerals of structural elements refer to the corresponding elements in FIGS. 3–7.

An overall method of fabricating a field emission device generally comprises the following steps: providing a substrate (step S1); depositing an insulating layer of predetermined thickness (step S7); depositing a metallic layer (step S8) having a thickness of only several hundred angstroms so as to extend parallel to the upper surface of the substrate to form an emitter layer; providing an opening (step S14) through the insulating layer and through the emitter layer, thereby forming an emitter edge of the emitter metallic layer; depositing a conformal layer of material only on the walls of the opening provided in step S14 to a predetermined thickness to make a spacer (steps S15 & S16); filling the opening at least partially with a phosphor layer (step S17) such that the conformal layer spaces the phosphor layer from the edge of the first metallic layer, where the predetermined conformal layer thickness equals a desired spatial distance between the emitter edge of the emitter layer and the phosphor layer, and making the phosphor layer of a thickness less that the predetermined thickness of the insulating layer deposited in step S7; and providing (in steps S12, S13 & S19) means for applying an electrical bias voltage to the emitter layer and to the phosphor layer, sufficient to cause cold cathode emission current of electrons from the emitter edge to the phosphor.

To fabricate a triode device with two control electrodes, the full process illustrated in FIGS. 8*a*, 8*b*, 9*a* and 9*b* is performed. A substrate 20 is provided (step S1), which may be a silicon wafer. An insulating layer 30 is deposited (step S2) on the substrate. This may be done, for example, by growing a film of silicon oxide approximately one micrometer thick on a silicon substrate. A pattern is defined on the insulator surface for depositing a conductive material. In the preferred process, a pattern of recesses is defined and etched (step S3) into the surface of the insulator layer. In step S4, metal is deposited in the recesses to form a buried anode contact 90, which is then planarized (step S5). While this is described here as a metal deposition, the conductive material deposited in step S4 may be a metal such as aluminum, tungsten, titanium, etc., or may be a transparent conductor such as tin oxide, indium tin oxide etc. (For applications using a common anode for all devices made on a substrate, the substrate may be conductive and perform the function of a buried anode contact. For such applications, steps S1 and S3 through S5 may be omitted, though step S2 may be required to insulate a control electrode if any.) If a control electrode 140 is to be incorporated into the device structure, a conductive material is deposited and patterned (step S6) on the planarized insulator surface, spaced from the buried anode contact material deposited in step S4. (The control electrode 140 may be deposited in a recess pattern and planarized, as in the case of the buried anode contact layer 90.) Another insulator layer 100 is deposited (step S7). This may be a chemical vapor deposition of silicon oxide to a thickness of about 0.5 to 2 micrometers, for example. An ultra-thin layer of conductive material of suitably low work function is deposited (step S8) to form an emitter layer 50, and patterned. Preferred emitter materials are titanium, tungsten, titanium-tungsten alloy, tantalum, or molybdenum, but many other conductors may be used, such as aluminum, gold, silver, copper, copper-doped aluminum, platinum, palladium, polycrystalline silicon, etc. or transparent thin film conductors such as tin oxide or indium tin oxide (ITO). The emitter layer deposition in step S8 is controlled to form a film preferably of about 100–200 Angstroms thickness in order to have an emitter edge or tip in the final structure that has a radius of curvature preferably less than 0.05 micrometer and more preferably less than 0.01 micrometer. An insulator 180 is deposited (step S9) over the emitter layer. Again this may be a chemical vapor deposition of silicon oxide to a thickness of about 0.5 to 2 micrometers, for example. If there are to be two control electrodes and symmetry with respect to the plane of emitter layer 50 is desired, then insulator layer 180 should be made the same thickness as insulator layer 100. If a second control electrode 170 is to be incorporated, a conductive material is deposited and patterned (step S10) to form the control electrode layer 170, and an insulating layer if desired is deposited and planarized (step S11). (The control electrode 170 may be deposited in a recess pattern and planarized, as in the case of the buried anode contact layer 90.)

This description of a fabrication process continues from this point with reference to FIG. 8*b* and FIG. 9*b*, respectively showing the remaining fabrication steps and the corresponding cross sectional views of the device. In step S12, contact holes are opened from the upper surface through insulator layer(s) to the emitter layer 50, to one or two control electrode layers 140 and/or 170 if any, and to the buried anode contact layer 90. These contact holes are filled with conductive material by conventional processes in step S13, to form conductive studs 120, 130 and 160 extending upward to the top surface. In step S14, an opening is provided to the buried anode contact layer 90. This opening is patterned to define space for anode 60 and space 200, and the pattern is made to intersect at least some portions of emitter layer 50 (and of control electrode layers 140 and 170 if any), to define emitting edge 110 of emitter layer 50 (and edge 190 of layer 140 if any, and the corresponding edge of layer 170 if any). This step is performed by using conventional directional etching processes such as reactive ion etching sometimes called "trench etching" in the semiconductor fabrication literature. In step S15, a conformal layer of material is deposited with predetermined thickness. This material could be any of several conformal materials such as parylene. In step S16, a directional etch is performed to remove the conformal layer everywhere except on the sidewalls of the opening provided in step S14. This provides a spacer of predetermined thickness on the sidewalls of that opening. Preferred spacer thickness is in the range 0.1 to 0.4 micrometer. The best spacer dimension depends on a number of variables, such as the emitter work function, the emitter edge radius of curvature, and the operating bias voltage range desired. That spacer will define the predetermined gap width separating the field emitter edge 110 from the anode phosphor 60 in the completed field emission device structure. In step S17, a phosphor 60 is deposited into the opening onto buried anode contact layer 90, preferably up to a level below the height of emitter layer 50, and any excess phosphor not in the opening is removed (by polishing, for example). Suitable phosphors include zinc oxide(ZnO), zinc sulfide (ZnS) and other compounds, where dopants are indicated herein after a colon following the primary phosphor material, viz.: ZnO:Zn; $SnO_2$:Eu; $ZnGa_2O_4$:Mn; $La_2O_2S$:Tb; $Y_2O_2S$:Eu; LaOBr:Tb; ZnS:Zn+$In_2O_3$; ZnS:Cu,Al+$In_2O_3$; (ZnCd)S:Ag+$In_2O_3$; and ZnS:Mn+$In_2O_3$. In this list of phosphors, the plus sign (+) denotes a mixture.

In step S18, the conformal layer material is removed, by a conventional plasma etch step, leaving the previously mentioned predetermined gap in space 200 between emitter edge 110 and phosphor 60. In step S19, means are provided for applying suitable electrical bias voltages, and (for devices incorporating control electrodes) suitable signal voltages. Such means may include, for example, contact pads selectively provided at the device top surface to make electrical contact with contacts 120, 130, and 160, and optionally may include wire bonds, means for tape automated bonding, flip-chip or C4 bonding, etc. In use of the device, of course, conventional power supplies and signal sources must be provided to supply the appropriate bias voltages and control signals. These will include providing sufficient voltage amplitude of the correct polarity (anode positive) to cause cold-cathode field emission of electron current from emitter edge 110 to anode phosphor 60 and anode buried contact 90. If desired, a passivation layer may be applied to the device top surface, except where there are conductive contact studs and/or contact pads needed to make electrical contacts.

It will be appreciated by those skilled in the art that arrays of field emission display cell structures may be made by simultaneously performing each step of the fabrication process described herein for a multiplicity of field emission devices on the same substrate, while providing interconnections as shown in the array structure drawings FIG. 6 and 7 or similar interconnections. An integrated array of field emission devices made in accordance with the present invention has each device made as described herein, and the devices are arranged as cells containing at least one emitter and at least one anode per cell. The cells are arranged along rows and columns, with the anodes interconnected along the columns for example, and the emitters interconnected along the rows.

If it is desired to have the field emission cell operating with a vacuum or a low pressure inert gas in space 200, it is necessary to enclose that space or cavity. This can be done by a process similar to that described in the publication "Ionizable Gas Device Compatible with Integrated Circuit Device Size and Processing," publication 30510 in "Research Disclosure", Number 305, September 1989. Such a process can be begun by etching a small auxiliary opening, connected to the opening provided in step S14, but not as deep as that opening (i.e. not extending as deeply as the level of buried anode contact layer 90. This auxiliary opening may be made at a portion of the cavity spaced away from the emitter edge area. The opening for the main cavity and the connected auxiliary opening are both filled temporarily with a sacrificial organic material, such as parylene, and then planarized. An inorganic insulator is deposited, extending over the entire device surface including over the sacrificial material, to enclose the cavity. A hole is made in the inorganic insulator by reactive ion etching only over the auxiliary opening. The sacrificial organic material is removed from within the cavity by a plasma etch, such as an oxygen plasma etch, which operates through the hole. The atmosphere around the device is then evacuated to evacuate the cavity. If an inert gas filler is desired, then that gas is introduced at the desired pressure. Then the hole and auxiliary opening are immediately filled by sputter-depositing an inorganic insulator to plug the hole. The plug of inorganic insulator seals the cavity and retains either the vacuum or any inert gas introduced. This process for vacuum or gas atmospheres is not illustrated in FIGS. 8*a*, 8*b*, 9*a* and 9*b*.

There are many diverse uses for the field emission display cell structure and fabrication process of this invention, especially in making flat panel displays for displaying images and for displaying character or graphic information with high resolution. It is expected that the type of flat panel display made with this invention can replace many existing displays including liquid crystal displays, because of their lower manufacturing complexity and cost, lower power consumption, higher brightness, and improved range of viewing angles. Displays made in accordance with the present invention are also expected to be used in new applications such as displays for virtual reality systems. In embodiments using substantially transparent substrates and films, displays incorporating the structures of the present invention are especially useful for augmented-reality displays.

Other embodiments of the invention to adapt it for various uses and conditions will be apparent to those skilled in the art from a consideration of this specification or from practice of the invention disclosed herein. For one example, additional electrodes such as screen electrodes may be incorporated into the structures disclosed to perform functions analogous to screen grids and other kinds of electrodes such as those used in tetrodes, pentodes, etc. known in vacuum tube art. For another example, the upper surface of the phosphor and/or anode may be made non-planar to shape the electric field and/or to optimize uniformity of the phosphor's light emission. For yet another example, the display cell may be made with a plurality of anode phosphors having different colors of light emission for color displays. These may have red, green and blue phosphors for the RGB type of display. Also the order of the various fabrication process steps may be varied for some purposes, and some process steps may be omitted for fabrication of the simpler structures. It is intended that the specification and examples be considered as exemplary only, with the true scope and spirit of the invention being defined by the following claims.

Having described my invention, I claim:

1. A method of fabricating a field emission device, comprising the steps of:

(a) providing a substrate;

(b) disposing a first insulating layer upon said substrate, said first insulating layer being of predetermined thickness;

(c) disposing a first conductive layer having a thickness of only several hundred angstroms relative to the upper surface of said substrate, said first conductive layer being disposed so as to extend parallel to the upper surface of said substrate, said first conductive layer having a bottom surface defining an emitter plane;

(d) providing an opening through said first insulating layer and through said first conductive layer, thereby forming an edge of said first conductive layer;

(e) disposing a conformal layer of material only on the walls of said opening provided in step (d), said conformal layer being of predetermined thickness;

(f) filling said opening partially with a phosphor layer such that said conformal layer spaces said phosphor layer from said edge of said first conductive layer, said predetermined conformal layer thickness equaling a desired spatial distance between said edge of said first conductive layer and said phosphor layer, and said phosphor layer being of a thickness less than said predetermined thickness of said first insulating layer disposed in step (b), said phosphor layer thereby having a top surface lying below said emitter plane; and (g) providing means for applying an electrical bias voltage to said first conductive layer and to said phosphor layer, said bias voltage to be applied being sufficient to cause cold cathode emission current of electrons from said edge of said first conductive layer to said phosphor layer.

2. A method of fabricating a field emission device as recited in claim 1, further comprising the step of removing said conformal layer from between said first conductive layer and said phosphor layer.

3. A method of fabricating a field emission device as recited in claim 1, wherein said substrate providing step (a) comprises providing a conductive substrate.

4. A method of fabricating a field emission device as recited in claim 3, wherein said electrical bias voltage applying means providing step (g) comprises providing means for applying a bias voltage to said conductive substrate.

5. A method of fabricating a field emission device as recited in claim 1, wherein said substrate providing step (a) further comprises the steps of:

providing an insulating substrate, and disposing a second conductive layer upon said insulating substrate.

6. A method of fabricating a field emission device as recited in claim 5, wherein said electrical bias voltage applying means providing step (g) comprises providing means for applying a bias voltage to said second conductive layer.

7. A method of fabricating a field emission device as recited in claim 5, wherein said second conductive layer disposing step further comprises patterning said second conductive layer to form a buried conductive anode.

8. A method of fabricating a field emission device as recited in claim 5, further comprising the steps of:

patterning said insulating substrate and selectively etching said insulating substrate to form an opening for said second conductive layer, and disposing said second conductive layer within said etched opening in said insulating substrate to produce a buried conductive anode layer.

9. A method of fabricating a field emission device as recited in claim 1, further comprising the steps of:

disposing a third conductive layer spaced from said first conductive layer, and providing means for applying an electrical signal to said third conductive layer, said electrical signal to be applied being sufficient to control said current of electrons.

10. A method of fabricating a field emission device as recited in claim 9, wherein said third conductive layer is disposed prior to said first insulating layer disposing step (b).

11. A method of fabricating a field emission device as recited in claim 9, further comprising the step of disposing a second insulating layer on said first conductive layer, and wherein said third conductive layer disposing step is performed after said first conductive layer disposing step (c).

12. A method of fabricating a field emission device as recited in claim 1, further comprising the steps of:

disposing a third conductive layer spaced from said first conductive layer prior to said first insulating layer disposing step (b), disposing a second insulating layer on said first conductive layer, disposing a fourth conductive layer on said second insulating layer, both said second insulating layer and said fourth conductive layer being disposed after said first conductive layer disposing step (c), and providing means for applying electrical signals to said third conductive layer and to said fourth conductive layer, each of said electrical signals to be applied being sufficient to control said current of electrons.

13. A method of fabricating a field emission device as recited in claim 12, wherein said electrical signals applying means providing step comprises providing electrically common electrical signals applying means to both said third and fourth conductive layers, to cause said third and fourth conductive layers to function together as a single control electrode.

14. A method of fabricating a field emission device as recited in claim 1, wherein said first conductive layer disposing step (c) comprises controlling the variables of deposition rate and deposition time to deposit said first conductive layer to a thickness between about 100 Angstroms and about 300 Angstroms.

15. A method of fabricating a field emission device, comprising the steps of:

(a) providing an insulating substrate;

(b) disposing a first conductive layer upon said insulating substrate, said first conductive layer being transparent;

(c) disposing a first insulating layer upon said substrate, said first insulating layer being of predetermined thickness;

(d) disposing a second conductive layer having a thickness of only several hundred angstroms relative to the upper surface of said substrate, said second conductive layer being disposed so as to extend parallel to the upper surface of said substrate;

(e) providing an opening through said first insulating layer and through said second conductive layer, thereby forming an edge of said second conductive layer;

(f) disposing a conformal layer of material only on the walls of said opening provided in step (d), said conformal layer being of predetermined thickness;

(g) filling said opening at least partially with a phosphor layer such that said conformal layer spaces said phosphor layer from said edge of said second conductive layer, said predetermined conformal layer thickness equaling a desired spatial distance between said edge of said first conductive layer and said phosphor layer, and said phosphor layer being of a thickness less than said predetermined thickness of said first insulating layer disposed in step (c); and (h) providing means for applying an electrical bias voltage to said second conductive layer and to said phosphor layer, said bias voltage to be applied being sufficient to cause cold cathode emission current of electrons from said edge of said second conductive layer to said phosphor layer.

16. A method of fabricating a field emission device as recited in claim 15, wherein said insulating substrate providing step (a) comprises providing a substantially transparent substrate, and said first conductive layer disposing step (b) further comprises patterning said first conductive layer to form a buried transparent anode.

17. A method of fabricating a field emission device as recited in claim 15, further comprising the steps of:

disposing a third conductive layer spaced from said second conductive layer, said third conductive layer being transparent; and providing means for applying an electrical signal to said third conductive layer, said electrical signal to be applied being sufficient to control said current of electrons.

18. A method of fabricating a field emission device, comprising the steps of:

(a) providing a flat substrate;

(b) disposing a layer of insulator on said substrate to form a first insulating layer having a top surface;

(c) patterning said first insulating layer and etching said first insulating layer to form a first opening for conductive material;

(d) disposing said conductive material in said first opening to form a buried anode contact layer;

(e) disposing a conductive layer selectively on said top surface of said first insulating layer, and spaced from said buried anode contact layer to form a control electrode layer;

(f) disposing a layer of insulator to form a second insulating layer over said control electrode layer;

(g) disposing a conductive layer having a thickness of only several hundred angstroms over said second insulating layer to form a thin emitter layer;

(h) disposing a third insulating layer over said thin emitter layer;

(i) providing an opening through said third insulating layer, said thin emitter layer, said second insulating layer, and said control electrode layer, thereby forming an emitter edge of said thin emitter layer and a control electrode edge of said control electrode layer while providing an opening to the top surface of said buried anode contact layer;

(j) disposing a conformal layer of material only on the walls of said opening, said conformal layer having a predetermined thickness to form a spacer;

(k) disposing a phosphor layer on said buried anode contact layer within said opening provided in step (i) to a predetermined thickness less than the distance from the top surface of said buried anode layer to the bottom surface of said thin emitter layer;

(l) removing said conformal layer from between said emitter edge and said phosphor layer;

(m) providing means for applying an electrical bias voltage to said emitter layer and to said buried anode contact layer, said bias voltage to be applied being sufficient to cause cold cathode emission current of electrons from said emitter edge to said phosphor layer; and (n) providing means for applying a signal voltage to said control electrode layer, said signal voltage being sufficient to control said current of electrons.

19. A method of fabricating a field emission device as recited in claim 18, further comprising the steps of:

(o) disposing a conductive layer over said third insulating layer to form a second control electrode layer;

(p) while performing said opening providing step (i), providing an opening through said second control electrode layer;

said steps (o) and (p) being performed to form a second control electrode layer having a second control electrode edge aligned above said emitter edge; and (q) providing means for applying a signal voltage to said second control electrode layer sufficient to control said current of electrons.

20. A method of fabricating a field emission device as recited in claim 19, wherein said fourth conductive layer disposing step (o) comprises disposing a transparent conductive layer, thereby fabricating a transparent field emission device.

21. A method of fabricating a field emission device as recited in claim 18, wherein said conformal layer disposing step 6) further comprises the steps of:

depositing a conformal layer in said opening, and directionally etching said conformal coating until said conformal coating remains only on said walls of said opening and has said predetermined thickness.

22. A method of fabricating a field emission device as recited in claim 18, wherein said substrate providing step (a) comprises providing a transparent substrate, and said disposing steps (b), (d), (e), (f), (g), (h), and (k) comprise disposing transparent materials of the respectively recited characteristics, thereby fabricating a transparent field emission device.

23. A method of fabricating a field emission device as recited in claim 18, wherein said phosphor layer disposing step (k) comprises depositing a phosphor material selected from the list consisting of: ZnO:Zn.; $SnO_2$:Eu; $ZnGa_2O_4$:Mn; $La_2O_2S$:Tb; $Y_2O_2S$:Eu; LaOBr:Tb; ZnS:Zn+$In_2O_3$; ZnS:Cu,Al+$In_2O_3$; (ZnCd)S:Ag+$In_2O_3$; and ZnS:Mn+$In_2O_3$.

24. A method of fabricating a field emission device, comprising the steps of:

(a) providing an insulating substrate;

(b) disposing a first conductive layer upon said insulating substrate, said first conductive layer being transparent;

(c) disposing a second conductive layer spaced from said first conductive layer, said second conductive layer being transparent;

(d) disposing a first insulating layer upon said first conductive layer, said first insulating layer being of predetermined thickness;

(e) disposing a third conductive layer having a thickness of only several hundred angstroms relative to the upper surface of said substrate, said third conductive layer being disposed so as to extend parallel to the upper surface of said substrate;

(f) disposing a second insulating layer on said third conductive layer;

(g) disposing a fourth conductive layer on said second insulating layer, said fourth conductive layer being transparent;

(h) providing an opening through said first insulating layer and through said third conductive layer, thereby forming an edge of said third conductive layer;

(i) disposing a conformal layer of material only on the walls of said opening provided in step (h), said conformal layer being of predetermined thickness;

(j) filling said opening partially with a phosphor layer such that said conformal layer spaces said phosphor layer from said edge of said second conductive layer, said predetermined conformal layer thickness equaling a desired spatial distance between said edge of said first conductive layer and said phosphor layer, and said phosphor layer being of a thickness less than said predetermined thickness of said first insulating layer disposed in step (d);

(k) providing means for applying an electrical bias voltage to said third conductive layer and to said phosphor layer, said bias voltage to be applied being sufficient to cause cold cathode emission current of electrons from said edge of said third conductive layer to said phosphor layer; and (l) providing means for applying electrical signals to said second conductive layer and to said fourth conductive layer, each of said electrical signals to be applied being sufficient to control said current of electrons.

* * * * *